US010227972B2

(12) United States Patent
Shao

(10) Patent No.: US 10,227,972 B2
(45) Date of Patent: Mar. 12, 2019

(54) INFLATABLE OBJECT WITH PRESSURE SENSITIVE PUMP

(71) Applicant: RGSTYLE, LLC, Lynnwood, WA (US)

(72) Inventor: Chi Yuan Shao, Lynnwood, WA (US)

(73) Assignee: Jiu-I (Joey) Lu, Mukilteo, WA (US)

( * ) Notice: Subject to any disclaimer, the term of this patent is extended or adjusted under 35 U.S.C. 154(b) by 14 days.

(21) Appl. No.: 15/453,300

(22) Filed: Mar. 8, 2017

(65) Prior Publication Data

US 2017/0321688 A1 Nov. 9, 2017

Related U.S. Application Data

(63) Continuation-in-part of application No. 15/150,392, filed on May 9, 2016.

(51) Int. Cl.

| | |
|---|---|
| ***F04B 49/08*** | (2006.01) |
| ***F04B 49/02*** | (2006.01) |
| ***A63H 3/06*** | (2006.01) |
| ***F04B 17/03*** | (2006.01) |
| ***F04B 49/06*** | (2006.01) |

(52) U.S. Cl.

CPC ..... *F04B 49/08* (2013.01); *A63H 3/06* (2013.01); *F04B 17/03* (2013.01); *F04B 49/02* (2013.01); *F04B 49/065* (2013.01); *F04B 2205/05* (2013.01); *F04B 2207/043* (2013.01)

(58) Field of Classification Search

CPC ..... F04B 49/08; F04B 49/02; A63H 33/22

See application file for complete search history.

(56) References Cited

U.S. PATENT DOCUMENTS

| | | | | |
|---|---|---|---|---|
| 4,714,098 | A | 12/1987 | Stuckel | |
| 4,908,895 | A | 3/1990 | Walker | |
| 5,197,461 | A | 3/1993 | Petajan et al. | |
| 5,729,853 | A | 3/1998 | Thompson | |
| 6,591,437 | B1 | 7/2003 | Phillips | |
| 8,863,771 | B2 | 10/2014 | Wang et al. | |
| 9,327,817 | B1 | 5/2016 | Roach | |
| 9,427,054 | B1 * | 8/2016 | Al-Saleh | A45C 1/12 |
| 2007/0094907 | A1 * | 5/2007 | Scarberry | G09F 15/0025 40/610 |

* cited by examiner

*Primary Examiner* — Jason K Niesz

(74) *Attorney, Agent, or Firm* — WHGC, P.L.C.; John F. O'Rourke

(57) ABSTRACT

An inflatable object with a sag to enclose pressurized air to a predetermined threshold pressure and to obtain a shape, a decorative dress to cover at least a portion of the sag and having characteristics of an object having the shape when covering the sag outer surface, couplings on the sag outer surface to which the decorative dress is attached, a frame to support at least a portion of the sag, an air pump coupled to the sag by a unidirectional inlet valve, and to provide the insufflated air to the sag, an optional sensor coupled to the sag and configured to detect sag air pressure; and a controller, coupled between the sensor and the pump. The controller operates the pump to automatically maintain a threshold pressure of air within the sag. The sensor and the controller are disposed on the sag surface.

18 Claims, 4 Drawing Sheets

INFLATABLE OBJECT WITH PRESSURE SENSITIVE PUMP

CROSS-REFERENCE TO RELATED APPLICATIONS

The present application is a Continuation-in-Part of U.S. patent application Ser. No. 15/150,392, filed May 9, 2016, and entitled "INFLATABLE OBJECT WITH PRESSURE SENSITIVE PUMP," which is incorporated herein in its entirety.

BACKGROUND

1. Field of the Invention

The present invention is related to inflatable objects and, in particular, to inflatable objects with pressure sensors.

2. Background Art

Typically, inflatable objects are limited in shapes, such as tubes and beach balls, and can be difficult to store and to ship. Also, some inflatable objects, such as furniture (e.g., a chair), are uncomfortable to sit in and may deflate slowly during use. In addition, inflatable objects can be cumbersome to inflate. A typical inflatable display is mostly a plastic body sewn with outer layer decorations. For this type of display, it cannot be folded, often needs to disassemble the finished goods to ship, and therefore, needs much larger room/space to ship and store, increasing the shipping costs.

Moreover, inflatable objects often do not have the cosmetic appeal as stuffed or carved display figures do. A large plush animal or display object may be expensive, and difficult to produce, ship, and store. Typical inflatable furniture and bean bags are not equipped with a sensor to control the air pressure within the forms. Further, it requires a longer time and more labor to assemble, therefore, a product that is easily folded, easily assembled and keeps its the shape is needed.

SUMMARY

Embodiments herein provide a decorative object, having a sag configured to enclose a gas and to obtain a preselected shape when insufflated with the gas, a decorative dress, configured to cover at least a portion of the sag, the dress having characteristics of a predetermined object having the preselected shape when covering the sag, an air pump coupled to the sag by a unidirectional inlet valve, the air pump configured to provide the insufflated gas to the sag, a sensor, coupled to the sag and configured to detect sag gas pressure; and a controller, coupled between the sensor and the air pump. The controller operates the air pump to automatically maintain a predetermined threshold pressure within the sag as sensed by the sensor, and wherein the decorative object is an inflatable object. In some embodiments, the air pump is driven by AC power. In other embodiments, the air pump is driven by DC power. In certain other embodiments, the air pump is attachable to the sag. In still other embodiments, the pump is a hand-operated air pump. In yet other embodiments, the pump can be a foot-operated air pump. In embodiments, the sensor and the controller are disposed on a surface of the sag. In certain embodiments, the sensor and the controller are integrated. In other embodiments, the sensor is omitted. In yet other certain embodiments, the sensor is integrated into the air pump. The air pump is configured to operate for a preset period and then to turn off. In embodiments, the decorative object also includes a frame configured to support at least a portion of the sag. There are couplings on the sag to which the dress is attached. In embodiments, the air pump is coupled to the unidirectional inlet valve by a second unidirectional inlet valve.

Embodiments herein also provide an inflatable object, having a sag configured to enclose pressurized air and to obtain a preselected shape when insufflated with air to a predetermined threshold pressure. The sag has an outer surface. Inflatable object embodiments also include a decorative dress, configured to cover at least a portion of the sag. The decorative dress has characteristics of a predetermined object having the preselected shape when covering the sag outer surface. There are couplings on the sag outer surface to which the decorative dress is attached. There also is a frame configured to support at least a portion of the sag. Furthermore, the inflatable object also includes an air pump, a controller, and a sensor. The air pump is coupled to the sag by a unidirectional inlet valve, and is configured to provide the insufflated air to the sag. The sensor is coupled to the sag and configured to detect sag air pressure. The controller is coupled between the sensor and the pump. The controller operates the pump to automatically maintain a predetermined threshold pressure of air within the sag as sensed by the sensor, and the sensor and the controller are disposed on a surface of the sag.

In embodiments of the inflatable object, the air pump is coupled to the unidirectional inlet valve by a second unidirectional inlet valve. In selected embodiments, the air pump is releasably coupled to the sag, allowing for interchangeable air pumps. In some embodiments, the air pump is driven by AC power. In other embodiments, the air pump is driven by DC power. In yet other embodiments, the sensor and the controller are integrated. The air pump is configured to operate for a preset period and then to turn off. In some selected embodiments, the sensor and the controller are separate. In other selected embodiments, a sensor is not provided. In other embodiments, the air pump is configured to operate for a preset period to maintain the preselected threshold of pressurized air, and then to turn off. In embodiments, the sag can be made of a lightweight, tough, soft and flexible airtight material including, without limitation, a polyvinyl chloride material, a thermoplastic elastomer material, a thermoplastic rubber material, or a polyethylene material.

BRIEF DESCRIPTION OF THE DRAWINGS

Embodiment of the present invention disclosed herein are illustrated by way of example, and are not limited by the accompanying figures, in which like references indicate similar elements, and in which.

Figure 1:
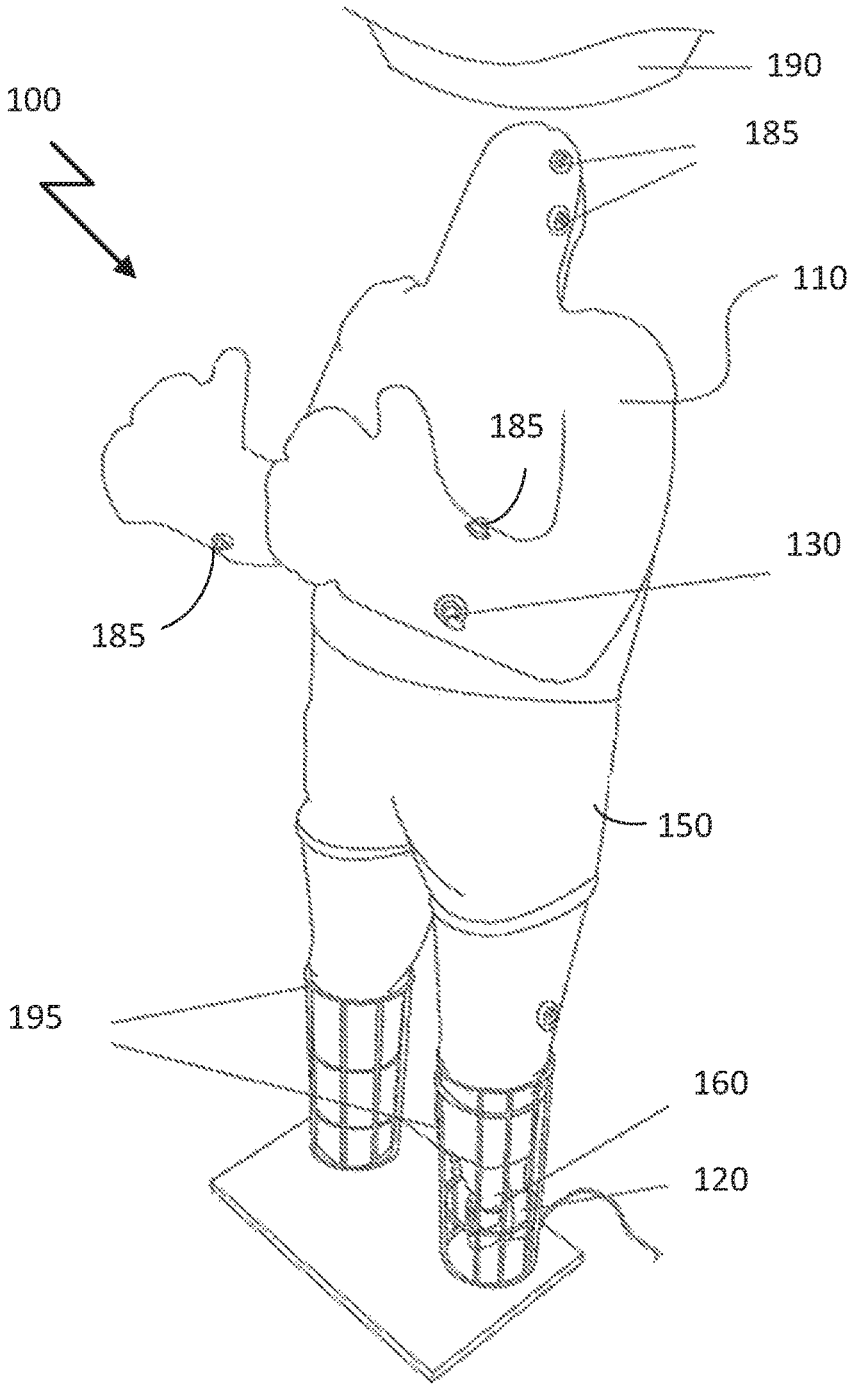
FIG. 1 is an illustration of an inflated object, in accordance with the teachings of the present invention.

The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated.

DESCRIPTION OF THE EMBODIMENTS

Figure 2:
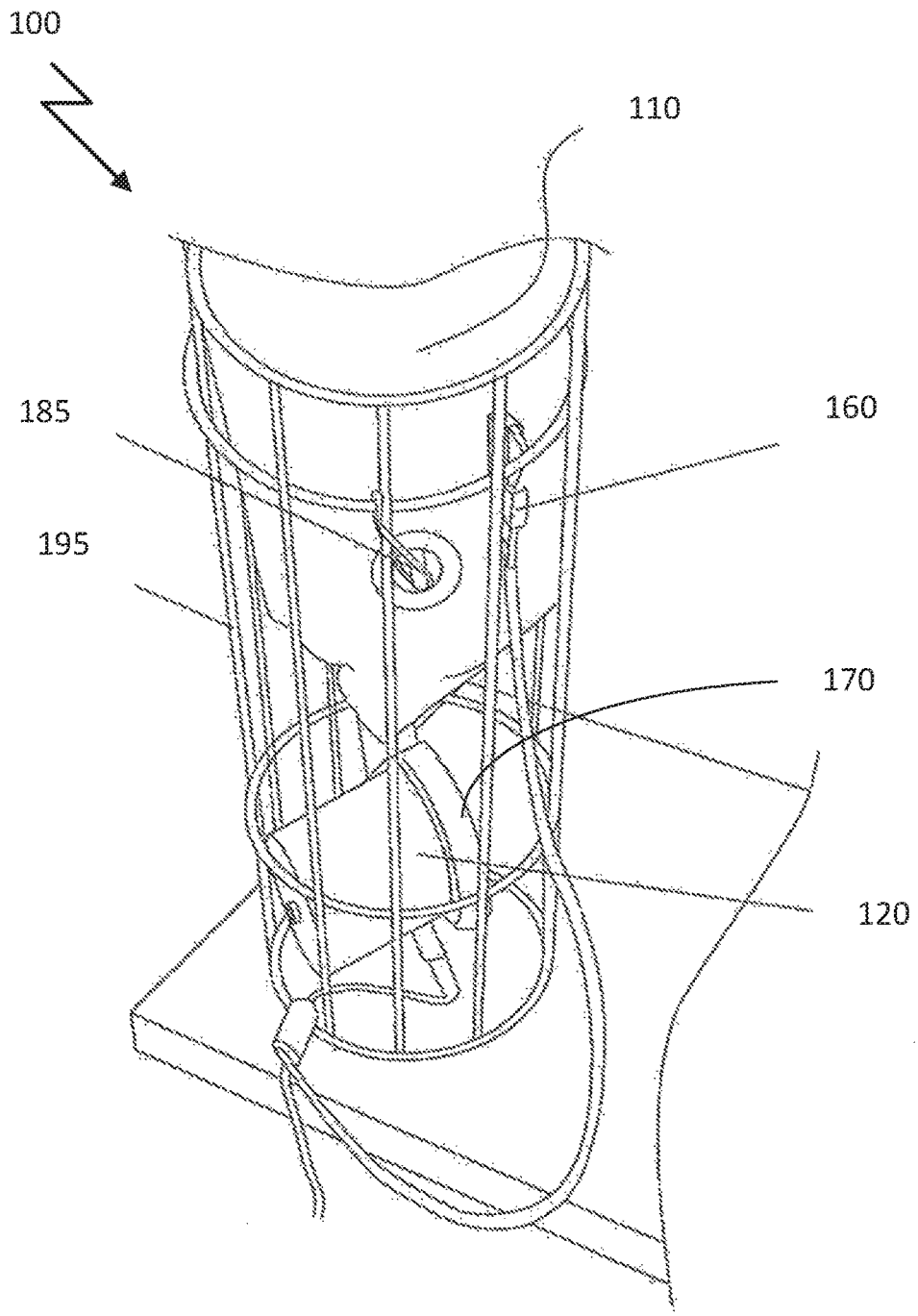
FIG. 2 is an illustration of a portion of the inflated object of FIG. 1, in accordance with the teachings of the present invention.
Figure 3:
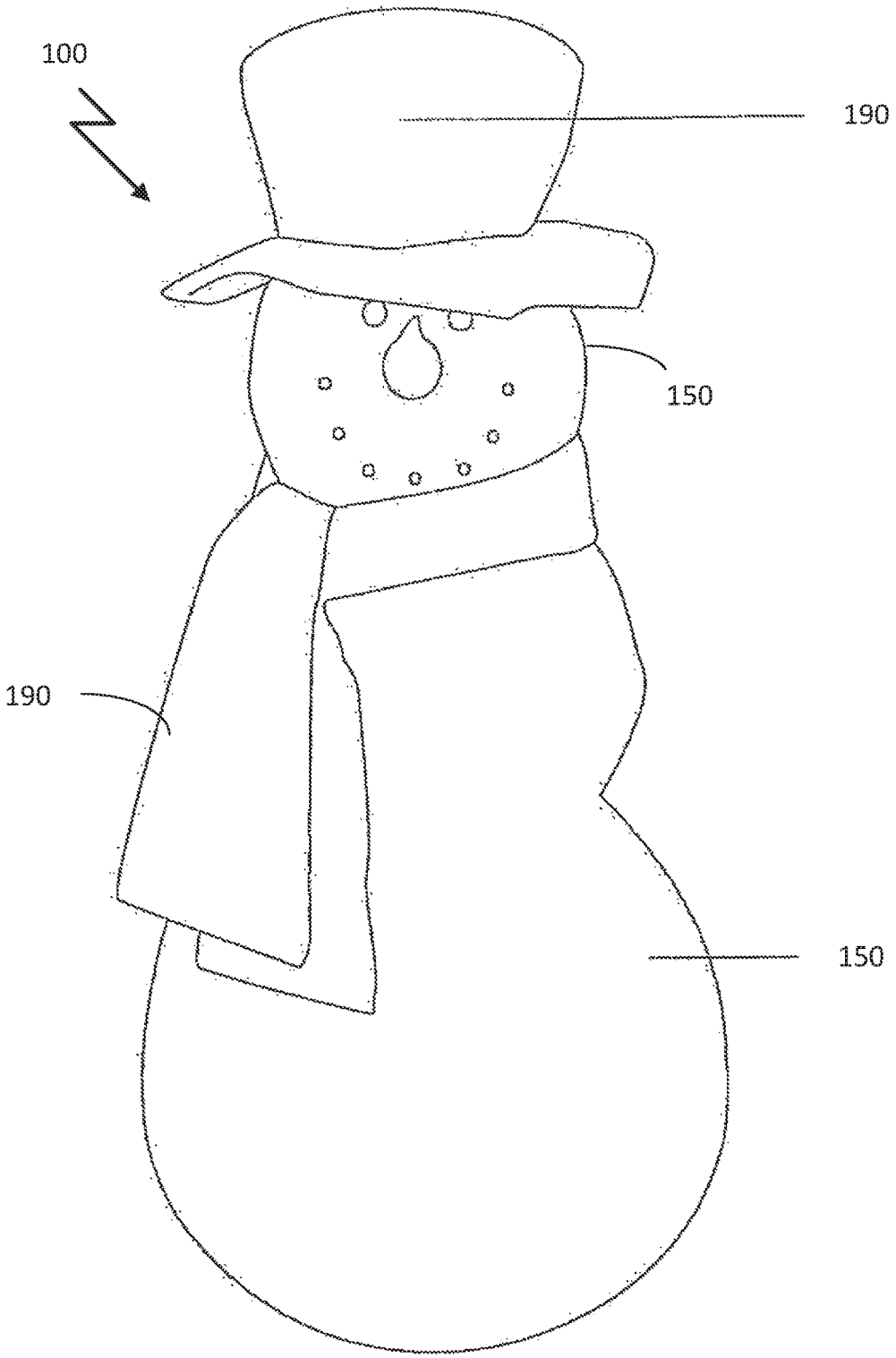
FIG. 3 is an illustration of a second inflated object, covered with dress and props, in accordance with the teachings of the present invention.
Figure 4:
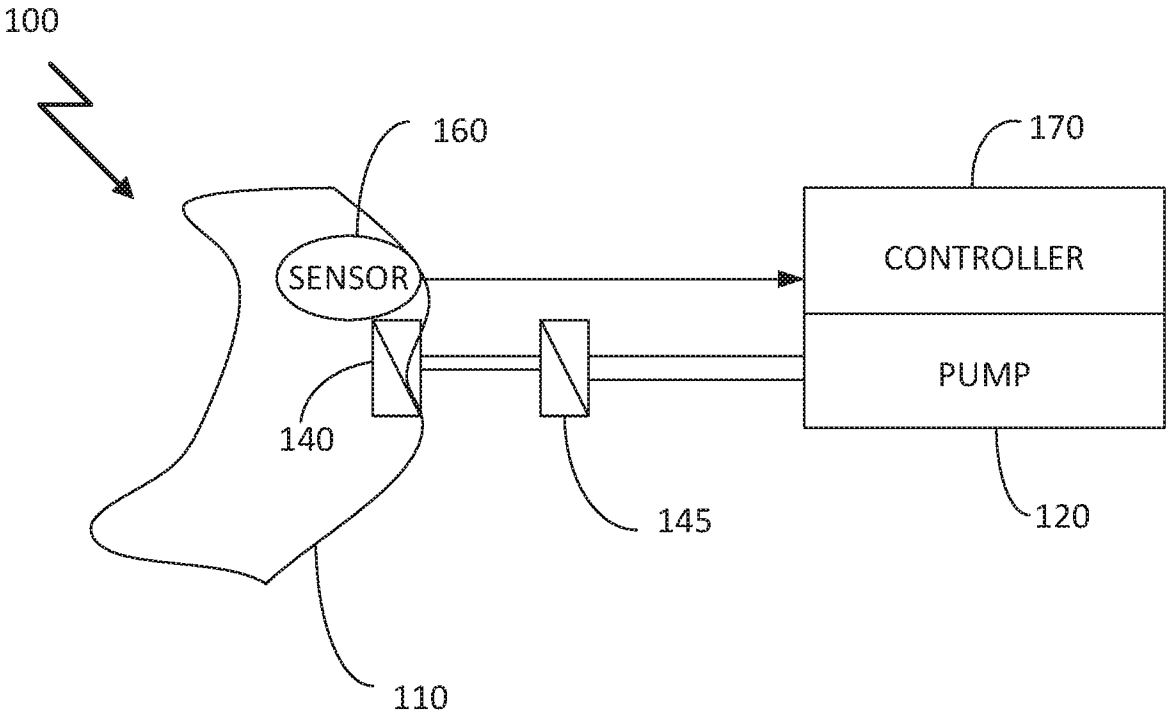
FIG. 4 is an illustration of an inflated object sensor, controller, air pump, and air valves, in accordance with the teachings of the present invention.

The embodiments herein can provide for plush objects of large size, large life-like displays, and whimsical presentations with ease of production, storage, and shipping, and with far less expense. It is possible to have the realistic cosmetic look as a plush or stuffed objects with the size of regular inflatable products. FIG. 1 represents a partially dressed SAG 110 having at least one prop 190. FIG. 2 represents one leg with frame 195 of FIG. 1. FIG. 3 represents object 100 with dress 150 of a snowman. FIG. 4 is a block illustration of pump 120, dual inlet valves 140, 145, sensor 160, and pump controller 170.

FIGS. 1-4 are emblematic of embodiments herein that provide a new inflatable object 100, which includes a highly flexible container, or SAG 110, which can enclose an insufflation gas; blower or air pump 120 providing the insufflation gas to inflate SAG 110; and dress 150, which can flexibly cover the SAG 110 as it is either inflated or deflated. SAG 110 can be a lightweight, tough, soft and flexible airtight elastic material, such as a polyvinyl chloride material, a thermoplastic elastomer material, a thermoplastic rubber material, a polyethylene material, or other like materials. Insufflation gas can be, for example, air, nitrogen, helium, argon, or other commonly-available gas. SAG 110 can have at least one valve 130 by which to deflate SAG 110, and one valve 140 by which to inflate SAG 110. Valve 130 can have an inlet on the interior of SAG 110, and an outlet on the outer surface of SAG 110. Valve 130 may be configured to rapidly deflate SAG 110. Valve 140 can be used to inflate SAG 110. Valve 140 can be positioned at or near SAG 110 bottom. Valve 140 can be a unidirectional valve, configured to allow gas flow into SAG 110.

Coupled to valve 140 inlet can be pump 120, which pumps gas into SAG 110. In some embodiments, pump 120 is separate from valve 140. This may allow for separate, interchangeable pumps. A second inlet valve 145 may be coupled to pump 120 outlet to further ensure that no gas escapes during insufflation of SAG 110. Dual inlet vales can further ensure that there is no leak on the SAG inflation input side. Pump 120 can be an electric pump. Coupled to operate pump 120 can be sensor 160 attached to controller 170. Sensor 160 may be integrated into air pump 120. Sensor 160 may detect the current inflated state of SAG 110 and, if the inflated state is below a predetermined threshold, controller 170 causes pump 120 to insufflate gas into SAG 110. By using pump 120, SAG 110 can be inflated more quickly than by manual methods. Pump 120, therefore, maintains SAG 110 at a predetermined inflation state. SAG 110 can be configured to be a wide variety of shapes, including practical, holiday, or whimsical shapes. Dress 150 can be configured to conform to an inflated SAG 110 by enrobing SAG 110 with dress 150, prior to inflation.

Dress 150 can include, without limitation, Characters, Animals, Symbols, Vegetables, Plants, Fruits, Bean bags, Clothing, Ornaments, Wings, Objects or Furniture, including indoor and outdoor décor. Alternately, dress 150 can be disposed on SAG 110 after inflation has been achieved. Dress 150 can be a covering that gives SAG 110 an appearance and texture consistent with its shape—for example, without limitation, either indoor furniture or outdoor furniture amenable to implementation as dress 150, such as an inflatable bed or platform, chairs, sofas, or ornaments, trees, shrubs, or plants, holiday ornaments, such as Santa Claus having a red-and-white felt-like costume and shiny boots, or a small object such as a dog, a cat, an elf, or a pillow, or a large stuffed animal such as reindeer, a deer, or a moose. Dress 150 can be made thick enough to prevent accidental punctures. Dress 150 also can be combined with a corresponding SAG 110. Where dress 150 and SAG 110 can be separated, either may be washable, if dirty.

A dressed object 100 can be inflated and maintained in appearance for the duration of its presentation by operation of sensor 160, controller 170, and pump 120, in concert with valve 140 and, if present, valve 145. Sensor 160 may be disposed on SAG 110, in controller 170, or in pump 120. Alternatively, sensor 160 may be omitted. Dress 150 can be attached to SAG 110 by couplings 185, which may include connecting rings or hook-and-loop attachments. Dress 150 may be a tactilely-pleasing material, including nap, velvet, or plush. SAG 110 can be a much larger object, such as a pumpkin, yet dress 150 for the pumpkin may be a fabric that consumes much less volume. Props 190 also can be attached to dress 150 to further accentuate the appearance of object 100. A prop 190 can be attuned to dress 150, and can include without limitation, a hat, shoes, a sword, a cap, a fishing pole, a scarf, or socks. Frame 195 may support at least a portion of SAG 110, if it is used at all. If used, frame 195 may support SAG 110 but be concealed by dress 150.

In general, once pump 120 is activated, sensor 160 senses a deflated state of SAG 110, and controller 170 causes pump 120 to insufflate gas into SAG 110, up to a predetermined threshold pressure within SAG 110. If gas leaks out of SAG 110 and SAG 110 pressure falls below the predetermined threshold pressure, controller 170 will cause pump 120 to insufflate gas into SAG 110 up to the predetermined threshold. In this way, the overall shape, size, and cosmetic appearance of SAG 110 can be maintained. However, if a large hole erupts and pump 120 operates longer than a preset period, for example, without limitation, 20 minutes, pump 120 will automatically shut off to prevent pump 120 overheating. Pump 120 may be driven by AC or by DC power. In alternative embodiments, controller 170 operates pump 120 to insufflate gas into SAG 110 for a preselected period of time. The preselected period of time may be up to and including a preset period, for example, 20 minutes, at which time pump 120 shuts off to avoid overheating. Controller 170 may detect the air pressure in SAG 110.

Once the period of presentation is over, dress 150 can be removed from SAG 110, and SAG 110 can be deflated. Alternatively, dress 150 can be removed from SAG 110 during or after SAG 110 is deflated. In the current embodiments, both SAG 110 and dress 150 are thin, sturdy, and easy to store and to handle. Frame 195 can be reduced down into a manageable size and configuration to allow for easy storage and freight, even for a six-to-ten-foot Christmas tree. In some embodiments, controller 170 is integrated with sensor 160, and may be disposed on the surface of SAG 110. In other embodiments, controller 170 can be separate from sensor 160. It may be attached to pump 120. In embodiments, pump 120 may be contained within support frame 195. This configuration can provide concealment and protection to pump 120 without affecting overall appearance. In other embodiments, pump 120 can be separate from, and sold independently of, one or more of SAG 110, dress 150, props 190, and frame 195. Furthermore, in certain other embodiments, sensor 160 may not be provided.

The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals represent similar parts throughout the several views of the drawings, although not every figure may repeat each and Every feature that has been shown in another figure in order to not obscure certain features or overwhelm the figure with repetitive indicia. It is understood that the invention is not limited to the specific methodology, devices, apparatuses, materials, applications, etc., described herein, as these may vary. It is also to be understood that the terminology used herein is used for the purpose of describing particular embodiments only, and is not intended to limit the scope of the invention.

What is claimed is:

1. A decorative object, comprising:

a sag, configured to enclose a gas and to attain a preselected shape when insufflated with the gas;

decorative dress, configured to removably cover at least a portion of the sag, the decorative dress having characteristics of a predetermined object bearing the preselected shape when covering the sag;

an air pump coupled to the sag by dual unidirectional inlet valves, the air pump configured to provide the insufflated gas to the sag;

and a controller having an integrated pressure sensor coupled to the air pump, wherein the controller operates the pump to automatically maintain a sensed predetermined threshold pressure within the sag.

2. The decorative object of claim 1, wherein the air pump is driven by AC power.

3. The decorative object of claim 1, wherein the air pump is driven by DC power.

4. The decorative object of claim 1, wherein the controller is disposed on a surface of the sag.

5. The decorative object of claim 4, wherein the controller is integrated with the air pump.

6. The decorative object of claim 2, wherein the air pump is configured to operate for a preset period and then to turn off.

7. The decorative object of claim 1, further comprising:

a frame configured to support at least a portion of the sag.

8. The decorative object of claim 1, further comprising:

couplings on the sag to which the dress is attached.

9. An inflatable object, comprising:

a sag, configured to enclose pressurized air, and to obtain a preselected shape when provided with pressurized air to a predetermined threshold pressure, the sag having an outer surface;

a decorative dress, configured to cover at least a portion of the sag outer surface, the decorative dress having characteristics of a predetermined object having the preselected shape when covering the sag outer surface, the decorative dress being washable;

couplings on the sag outer surface to which the decorative dress is attached;

a frame configured to support at least a portion of the sag;

an air pump coupled to the sag by dual unidirectional inlet valves, the air pump configured to provide the pressurized air to the sag, the air pump having an integrated pressure sensor; and a controller, coupled to the air pump, and configured to maintain the predetermined threshold pressure, wherein the controller operates the pump to automatically maintain a sensed predetermined threshold pressure of air within the sag, and wherein the controller is disposed on a surface of the sag.

10. The decorative object of claim 9, wherein the air pump is driven by AC power.

11. The decorative object of claim 9, wherein the air pump is driven by DC power.

12. The decorative object of claim 9, wherein the air pump is releasable from the sag.

13. The decorative object of claim 9, wherein the air pump is configured to operate for a preset period and then to turn off.

14. The decorative object of claim 9, wherein the controller and air pump are integrated.

15. The decorative object of claim 14, wherein the air pump is configured to operate for a preset period to maintain the preselected threshold of pressurized air, and then to turn off.

16. The decorative object of claim 15, wherein the sag and decorative dress comprise one of a Character, an Animal, a Symbol, a Vegetable, a Fruit, a Plant, a Pumpkin, a Holiday Ornament, a Bean Bag Furniture, Clothing, Furniture, or an Object.

17. The decorative object of claim 9, wherein the sag is made of a polyvinyl chloride, a thermoplastic elastomer, a thermoplastic rubber, or a polyethylene material.

18. The decorative object of claim 16, wherein the sag is made of a polyvinyl chloride, a thermoplastic elastomer, a thermoplastic rubber, or a polyethylene material.

* * * * *